US008911613B2

(12) United States Patent
Noh et al.

(10) Patent No.: US 8,911,613 B2
(45) Date of Patent: Dec. 16, 2014

(54) METHOD OF SIMULTANEOUSLY MANUFACTURING HIGH QUALITY NAPHTHENIC BASE OIL AND HEAVY BASE OIL

(75) Inventors: Kyung Seok Noh, Daejeon (KR); Jae Wook Ryu, Daejeon (KR); Do Hyoun Kim, Daejeon (KR); Gyung Rok Kim, Daejeon (KR); Seung Woo Lee, Daejeon (KR); Do Woan Kim, Daejeon (KR); Sun Choi, Daejeon (KR); Seung Hoon Oh, Seoul (KR); Byung Won Yoon, Daejeon (KR); Bum Suk Chun, Daejeon (KR)

(73) Assignee: SK Innovation Co., Ltd., Seoul (KR)

( * ) Notice: Subject to any disclaimer, the term of this patent is extended or adjusted under 35 U.S.C. 154(b) by 194 days.

(21) Appl. No.: 13/695,897

(22) PCT Filed: Nov. 2, 2010

(86) PCT No.: PCT/KR2010/007657
§ 371 (c)(1),
(2), (4) Date: Nov. 2, 2012

(87) PCT Pub. No.: WO2011/139008
PCT Pub. Date: Nov. 10, 2011

(65) Prior Publication Data

US 2013/0048537 A1 Feb. 28, 2013

(30) Foreign Application Priority Data

May 7, 2010 (KR) ..... 10-2010-0043152

(51) Int. Cl.

| | |
|---|---|
| ***C10G 55/06*** | (2006.01) |
| ***C10G 67/04*** | (2006.01) |
| ***C10G 69/04*** | (2006.01) |
| ***C10M 101/02*** | (2006.01) |
| ***C10G 55/08*** | (2006.01) |

(52) U.S. Cl.
CPC ..... *C10M 101/02* (2013.01); *C10G 55/08* (2013.01); *C10G 67/0463* (2013.01);

(Continued)

(58) Field of Classification Search
CPC ..... C10G 2300/107; C10G 2300/1077; C10G 2300/302; C10G 2300/4018; C10G 2400/10; C10G 55/08; C10G 67/0463; C10G 69/04
USPC ..... 208/45, 49, 58, 70, 78, 79, 134, 209
See application file for complete search history.

(56) References Cited

U.S. PATENT DOCUMENTS 5,358,627 A 10/1994 Mears et al.
6,103,101 A 8/2000 Fragelli et al.

(Continued)

FOREIGN PATENT DOCUMENTS

EP 0185448 A1 6/1986
KR 10-0262742 B1 9/2000

(Continued)

OTHER PUBLICATIONS

Niccum, P., et al., Processing HeavyEnds: Part 1, 2008, PTQ Q3 2008 KBR, p. 92-97.*

(Continued)

*Primary Examiner* — Walter D Griffin
*Assistant Examiner* — Derek Mueller
(74) *Attorney, Agent, or Firm* — Abelman, Frayne & Schwab

(57) ABSTRACT

Disclosed is a method of simultaneously manufacturing high quality naphthenic base oil and heavy base oil using a single catalyst system, by subjecting an oil fraction (slurry oil or light cycle oil) produced by fluid catalytic cracking and an oil fraction (deasphalted oil) produced by solvent deasphalting to hydrotreating, catalytic dewaxing and hydrofinishing of the single catalyst system, thereby obtaining not only products having low viscosity but also heavy base oil products (150BS) having high viscosity which was impossible to obtain using a conventional catalytic reaction process, and also thereby producing base oil products having different properties using the single catalyst system, thus generating economic benefits and exhibiting superior efficiency.

8 Claims, 1 Drawing Sheet

(52) U.S. Cl.
CPC ..... *C10G 69/04* (2013.01); *C10M 2203/1065* (2013.01); *C10M 2203/1085* (2013.01); *C10M 2230/02* (2013.01); *C10G 2300/4018* (2013.01); *C10G 2300/107* (2013.01); *C10G 2300/1077* (2013.01); *C10G 2300/302* (2013.01); *C10G 2400/10* (2013.01)
USPC ..... 208/70; 208/67; 208/69; 208/78; 208/79; 208/95

(56) References Cited

U.S. PATENT DOCUMENTS

| | | | | |
|---|---|---|---|---|
| 2007/0181461 | A1* | 8/2007 | Adams et al. | 208/58 |
| 2009/0020453 | A1 | 1/2009 | Tanaka et al. | |
| 2011/0005972 | A1 | 1/2011 | Kim et al. | |
| 2011/0089080 | A1 | 4/2011 | Kim et al. | |

FOREIGN PATENT DOCUMENTS

| | | | |
|---|---|---|---|
| KR | 10-0841804 | B1 | 6/2008 |
| KR | 10-0934331 | B1 | 12/2009 |
| WO | 2004033597 | A2 | 4/2004 |
| WO | 2004039919 | A2 | 5/2004 |
| WO | 2005-085394 | A1 | 9/2005 |

OTHER PUBLICATIONS

Extended European Search Report for 10851096.7 dated Dec. 18, 2013 (10 pages).
International Search Report for PCT/KR2010/007657 dated Jul. 27, 2011 (4 pages).

* cited by examiner

METHOD OF SIMULTANEOUSLY MANUFACTURING HIGH QUALITY NAPHTHENIC BASE OIL AND HEAVY BASE OIL

RELATED APPLICATIONS

This application is a United States national phase application under 35 USC §371 of PCT/KR2011/007657 filed on Nov. 2, 2010, and claims the benefit under 35 USC §119 of Korean patent application number KR 10-2010-0043152 filed May 7, 2010, the disclosures of which are incorporated herein by reference in their entireties.

TECHNICAL FIELD

The present invention relates to a method of simultaneously manufacturing high quality naphthenic base oil and heavy base oil using a single catalyst system.

BACKGROUND ART

Conventional heavy base oil products (e.g. 500N, 150BS, etc.) (Group I) having high viscosity have been typically manufactured by subjecting a mixture of atmospheric residue and vacuum residue or vacuum residue to solvent deasphalting process (SDA), thus obtaining deasphalted oil (DAO) having neither asphaltene nor impurities, and then subjecting the deasphalted oil to solvent extraction.

However, the heavy base oil thus manufactured has relatively high aromatic content and thus becomes unstable, and also may not satisfy a polycyclic aromatic (PCA) standard which becomes strictly restricted in recent years. Furthermore, because it is manufactured using solvent extraction, the production yield of base oil is low (on the order of 40~50%), environmental contaminants are discharged in a large amount, and an additional process is required to satisfy the PCA regulation standard (<3%).

Because of environmental problems and economical inefficiency, the number of plants that manufacture the base oil of Group I using solvent extraction is rapidly decreasing these days.

However, heavy base oil products are utilized in specific fields including automobile lubricant oil, fiber oil, paraffinic process oil or the like, and are continuously in demand. Accordingly, the supply of heavy base oil products falls short of the demand for them.

Research into manufacturing heavy base oil products using a catalytic reaction process is ongoing. However, because it is difficult to obtain heavy base oil having high viscosity such as 150BS or the like using conventional methods, limitations are imposed on obtaining heavy base oil products ranging from low viscosity to high viscosity using a single reaction process. Hence, there is a need to manufacture high quality heavy base oil, which is environmentally friendly and has high yield and a wide viscosity range.

DISCLOSURE OF INVENTION

Technical Problem

Leading to the present invention, intensive and thorough research into catalytic reaction processes for manufacturing heavy base oil products having various viscosity ranges, including products (500N, 150BS) having high viscosity, from deasphalted oil (DAO) obtained by subjecting a mixture of atmospheric residue and vacuum residue (AR/VR) or vacuum residue (VR) to solvent deasphalting (SDA), carried out by the present inventors aiming to solve the problems encountered in the related art, resulted in the finding that a catalytic reaction process used to manufacture high quality naphthenic base oil may also be utilized to manufacture heavy base oil.

Accordingly, the present invention is intended to provide a method of simultaneously manufacturing not only naphthenic base oil having low viscosity but also heavy base oil (150BS) having high viscosity, which was difficult to obtain using a conventional catalytic reaction process, using a single catalyst system.

Solution to Problem

An aspect of the present invention provides a method of simultaneously manufacturing naphthenic base oil and heavy base oil using a single catalyst system comprising a hydrotreating catalyst, a dewaxing catalyst and a hydrofinishing catalyst, the method comprising (a) preparing the feedstock for naphthenic base oil by separating appropriately light cycle oil or slurry oil which is produced by subjecting atmospheric residue to fluid catalytic cracking; (b) preparing the feedstock for heavy base oil by separating appropriately the deasphalted oil which is produced by subjecting vacuum residue or a mixture of atmospheric residue and vacuum residue to solvent deasphalting; (c) sequentially or simultaneously hydrotreating the light cycle oil, the slurry oil or the mixture thereof separated in (a) and the deasphalted oil separated in (b) in the presence of the hydrotreating catalyst, thus obtaining a hydrotreated oil fraction; (d) dewaxing the hydrotreated oil fraction in the presence of the dewaxing catalyst, thus obtaining a dewaxed oil fraction; and (e) hydrofinishing the dewaxed oil fraction in the presence of the hydrofinishing catalyst, thus obtaining a hydrofinished oil fraction.

Advantageous Effects of Invention

According to the present invention, not only products having low viscosity but also heavy base oil (150BS or the like) having high viscosity which was impossible to obtain using a conventional catalytic reaction process can be made, and base oil products having different properties can be produced using a single catalyst system, thus generating economic benefits and exhibiting superior efficiency. Also, by adjusting the ratio of atmospheric residue and vacuum residue and the separation conditions of vacuum distillation, the grade and production yield of final base oil can be controlled, thus appropriately meeting the demand and supply in the market as this change continuously. Also, when base oil is manufactured according to the present invention, the discharge of environmental contaminants can be reduced during the manufacturing procedure, thus making it possible to manufacture high quality base oil which is environmentally friendly and has high yield compared to conventional method.

BEST MODE FOR CARRYING OUT THE INVENTION

Hereinafter, a detailed description will be given of the present invention.

Figure 1:
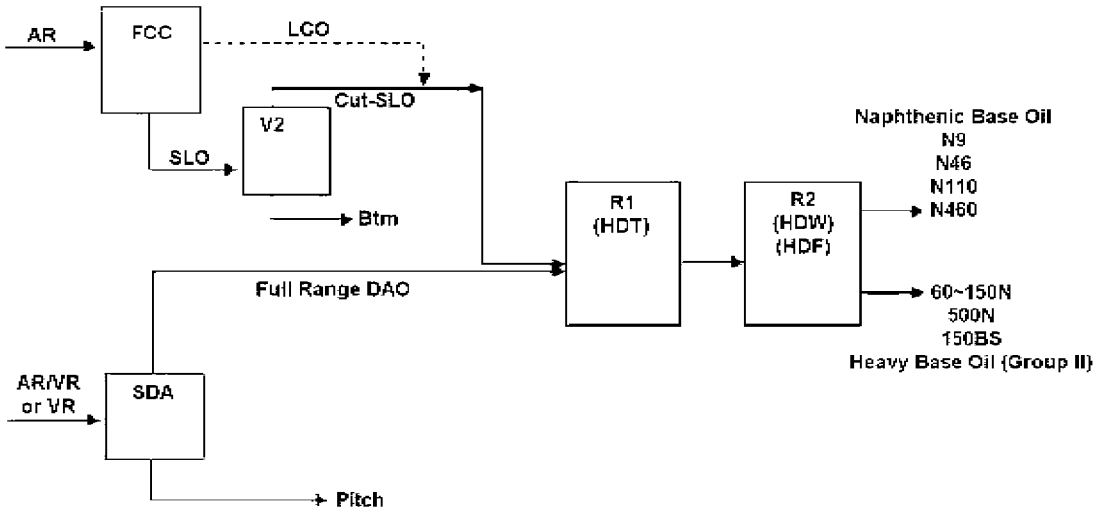
FIG. 1 schematically shows a process of simultaneously manufacturing high quality naphthenic base oil and heavy base oil by supplying deasphalted oil (DAO) obtained using solvent deasphalting (SDA) to a single catalyst system, in which the main feedstock of naphthenic base oil is cut-slurry oil (Cut-SLO)

According to the present invention, a method of simultaneously manufacturing naphthenic base oil and heavy base oil using a single catalyst system includes, as shown in FIG. 1, preparing a feedstock which is to be supplied to a single catalyst system, performing hydrotreating (HDT), catalytic dewaxing (CDW) and hydrofinishing (HDF) via the single catalyst system, and separating oil fractions according to the viscosity range.

Specifically, preparing the feedstock which is to be supplied to the single catalyst system may include preparing a feedstock of naphthenic base oil and preparing a feedstock of heavy base oil.

The feedstock of naphthenic base oil mainly results from separating light cycle oil (LCO) and slurry oil (SLO) from oil fractions produced by subjecting petroleum-based hydrocarbons to fluid catalytic cracking (FCC). This FCC process includes producing a light petroleum product from atmospheric residue (AR) under temperature and pressure conditions of 500~700° C. and 1~3 atm using FCC, and is used to obtain a volatile oil fraction as a main product and propylene, heavy cracking naphtha (HCN), LCO, and SLO as by-products. LCO or SLO but not the light oil fractions thus produced is separated using a separation tower. In the present invention, LCO and SLO may be used alone or in a mixture at a predetermined ratio, in order to supply it to a single catalyst system according to the present invention.

Figure 2:
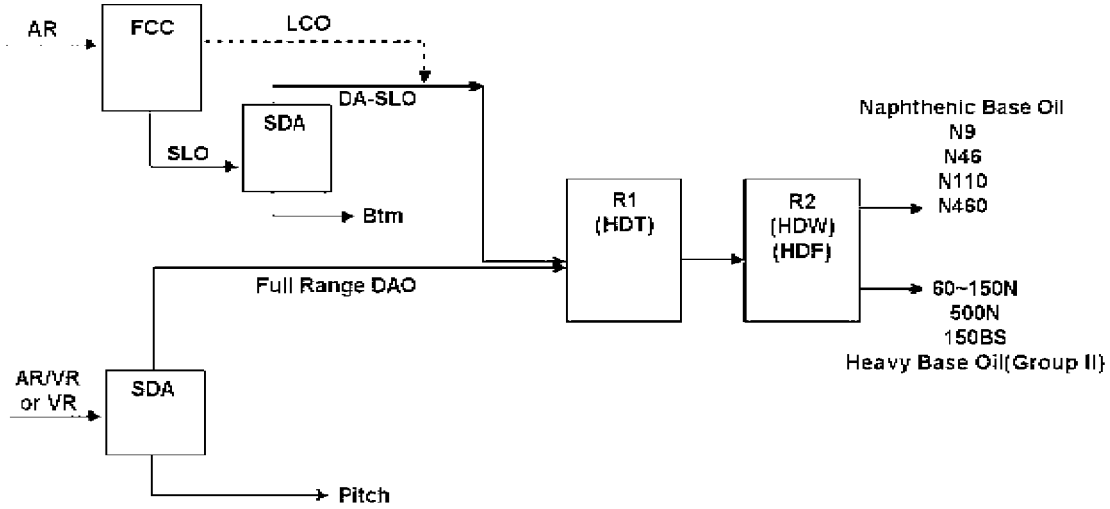
FIG. 2 schematically shows a process of simultaneously manufacturing high quality naphthenic base oil and heavy base oil by supplying deasphalted oil (DAO) obtained using solvent deasphalting (SDA) to a single catalyst system, in which the main feedstock of naphthenic base oil is deasphalted-slurry oil (DA-SLO)
Figure 3:
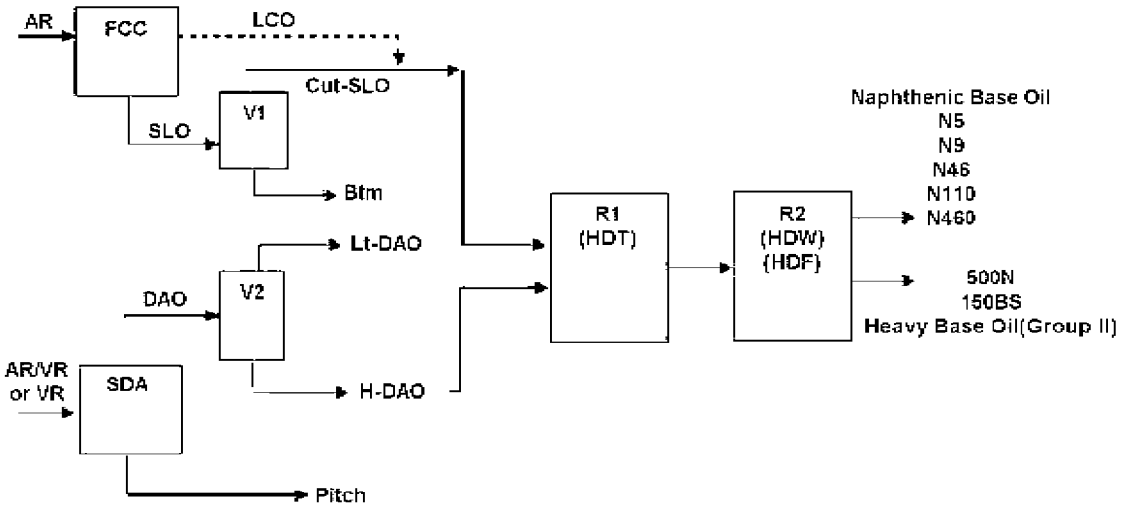
FIG. 3 schematically shows a process of simultaneously manufacturing high quality naphthenic base oil and heavy base oil by separating heavy deasphalted oil from deasphalted oil (DAO) obtained using solvent deasphalting (SDA) via vacuum distillation and then the heavy deasphalted oil to a single catalyst system.

According to a preferred embodiment of the present invention, SLO which is a feedstock supplied to a single catalyst system may be cut-slurry oil (Cut-SLO) obtained by subjecting FCC SLO to vacuum distillation, or deasphalted slurry oil (DA-SLO) obtained by subjecting FCC SLO to solvent deasphalting (FIGS. 1 and 2).

As shown in FIG. 1, the slurry oil is subjected to vacuum distillation using a vacuum separator, and then appropriately cut according to the desired viscosity range and mixed, thus preparing the feedstock which is to be supplied to the single catalyst system.

Also as shown in FIG. 2, the slurry oil is extracted using an solvent deasphaltene process (SDA), thus obtaining deasphalted slurry oil (DA-SLO), which may then be supplied to the single catalyst system according to the present invention. The solvent deasphalting (SDA) process used to obtain DA-SLO separates oil fractions via extraction using C3 and C4 as solvents, in which the reaction conditions thereof include an asphaltene separator pressure of 40~50 kg/cm$^2$, a deasphalted oil/pitch extraction temperature of 40~180° C., and a solvent to oil ratio (L/kg) ranging from 4:1 to 12:1.

In the case where lighter base oil such as electrical insulating oil and ink solvent is need to be produced, the above slurry oil (Cut-SLO or DA-SLO) may be used in a mixture with light cycle oil (LCO), as necessary.

The main feedstock of naphthenic base oil according to the present invention includes SLO which is an effluent of FCC, and exemplary Cut-1/2/3 fractions resulting from vacuum distillation of such SLO, and the properties thereof are summarized in Table 1 below (Cut-1 is an oil fraction corresponding to 0~35%, Cut-2 is an oil fraction corresponding to 35~50% and Cut-3 is an oil fraction corresponding to 50~100%, Cut-1/2/3 are separated by vol % from the light component).

TABLE 1

| | Unit | SLO | Cut-1 | Cut-2 | Cut-3 |
|---|---|---|---|---|---|
| Sulfur | wt % | 1.18 | 0.95 | 1.08 | 1.21 |
| Nitrogen | wt ppm | 2,240 | 2,078 | 1,979 | 2,969 |
| HPLC Aromatic Analysis | MAH (%) | 7.5 | 7.7 | 10.1 | 7.0 |
| | DAH (%) | 10.5 | 16.3 | 8.5 | 11.7 |
| | PAH (%) | 62.1 | 62.1 | 61.9 | 68.0 |
| | TAH (%) | 80.1 | 86.1 | 80.5 | 86.7 |
| Distillation (%) ASTM D-2887 | Initial Boiling Point (IBT) | 266 | 230 | 333 | 350 |
| | 10% | 349 | 334 | 369 | 404 |
| | 30% | 386 | 358 | 401 | 451 |
| | 50% | 424 | 376 | 424 | 485 |
| | 70% | 467 | 395 | 445 | 520 |
| | 90% | 529 | 423 | 473 | 545 |
| | Final Boiling Point (FBP) | 608 | 461 | 515 | 611 |

*MAH: Mono-Aromatic Hydrocarbon
*DAH: Di-Aromatic Hydrocarbon
*PAH: Poly-Aromatic Hydrocarbon
*TAH: Total Aromatic Hydrocarbon As is apparent from Table 1, SLO, Cut-1, Cut-2 and Cut-3 have various properties including sulfur content, nitrogen content, aromatic hydrocarbon proportions and a boiling point. In addition to the properties shown in Table 1, more various Cut-fractions may be obtained using vacuum distillation. According to an embodiment of the present invention, the volume ratio of Cut-1 and Cut-2 may be appropriately adjusted in consideration of the viscosity range of final products and product slate, thus ensuring an optimal feedstock.

For example, a mixture of Cut-1 having a boiling point of about 230~465° C. and Cut-2 having a boiling point of 330~520° C. may be supplied to a single catalyst system according to the present invention, and thus subjected to hydrotreating, catalytic dewaxing and hydrofinishing, thereby obtaining high quality naphthenic base oil products having various low/medium viscosities such as N5 (K-Vis@40° C.~4.2~4.5 cSt), N9 (K-Vis@40° C.~8.9~9.2 cSt), N46 (K-Vis@40° C.~43~47 cSt), N110 (K-Vis@40° C.~98~105 cSt), N460 (K-Vis@40° C.~370~390 cSt) and so on. As well, upon feedstock production, as the ratio of Cut-1 and Cut-2 is adjusted to fall within the range, the product slate ratio may be controlled.

According to the present invention, not only the naphthenic base oil but also heavy base oil can be manufactured using the single catalyst system, thus generating economic benefits and exhibiting superior efficiency.

The main feedstock of heavy base oil includes deasphalted oil (DAO) obtained by subjecting vacuum residue (VR) or a mixture of atmospheric residue (AR) and vacuum residue (VR) at an appropriate ratio to solvent deaspahalting process (SDA), or an oil fraction obtained by subjecting deasphalted oil (DAO) to vacuum distillation so as to be adapted for final products having desired viscosity or to maximally produce heavy grade base oil such as 500N or 150BS.

Useful as the main feedstock of heavy base oil according to the present invention, deasphalted oil (DAO) is obtained by mixing atmospheric residue (AR) and vacuum reside (VR) at a ratio of 1:1 and then subjecting the mixture to solvent deasphalting process (SDA), and the properties thereof are shown in Table 2 below. In the table, the first line represents DAO (Full Range DAO) obtained using SDA, and the second and third lines represent light deasphalted oil (Lt-DAO) and heavy deasphalted oil (H-DAO) separated by subjecting the above Full Range DAO to vacuum distillation (V2).

TABLE 2

| | Unit | Full Range DAO | Lt-DAO | H-DAO |
|---|---|---|---|---|
| API | 60° F. | 21.2 | 23.4 | 20.3 |
| Sulfur | wt % | 2.8 | 2.6 | 2.9 |
| Nitrogen | wt ppm | 930 | 640 | 1,420 |
| HPLC | MAH (%) | 32.0 | 29.4 | 35.5 |
| Aromatic | DAH (%) | 10.5 | 12.6 | 11.0 |
| Analysis | PAH (%) | 7.7 | 5.1 | 8.9 |
| | TAH (%) | 50.2 | 47.1 | 55.4 |
| Distillation | IBP | 247 | 227 | 410 |
| (%) ASTM | 10% | 380 | 342 | 481 |
| D-2887 | 30% | 446 | 396 | 523 |
| | 50% | 493 | 428 | 555 |
| | 70% | 539 | 455 | 586 |
| | 90% | 606 | 490 | 636 |
| | FBP | 720 | 572 | 720 |

As is apparent from Table 2, the distillation distribution of deasphalted oil (DAO) is heavier and wider than that of slurry oil. When Full Range DAO is subjected to hydrotreating/catalytic dewaxing/hydrofinishing using the single catalyst system, not only base oil (60N~150N) of Group II having medium viscosity but also heavy base oil such as 500N/150BS may be obtained. Particularly in the case where heavy base oil corresponding to 500N or 150BS is manufactured at high yield taking into consideration the demand in the market and the product slate, the Full Range DAO is subjected to vacuum distillation, so that Lt-DAO is removed, and H-DAO which may be obtained from the bottom of the tower is used as a feedstock.

As seen in Tables 1 and 2, because general naphthenic base oil and heavy base oil have about 0.1~0.15 wt % sulfur, about 500~1000 ppm nitrogen and 10~20 wt % aromatic component, the feedstock supplied to the single catalyst system has much higher impurity and aromatic contents compared to those of the napthenic base oil and heavy base oil.

Thus, the feedstock of naphthenic base oil and the feedstock of heavy base oil may be converted into products having the quality desired via the single catalyst system according to the present invention.

The single catalyst system according to the present invention includes a hydrotreating catalyst, a dewaxing catalyst and a hydrofinishing catalyst, so that hydrotreating, catalytic dewaxing and hydrofinishing are sequentially performed. In respective reaction processes of the single catalyst system, the reaction temperature, reaction pressure, type of catalyst, liquid hourly space velocity (LHSV) and volume ratio of hydrogen to feedstock may be determined depending on the feedstock, product target and reaction condition. In particular, the single catalyst system according to the present invention is a modification of a catalytic reaction process conventionally used to manufacture high quality naphthenic base oil, in lieu of the solvent extraction conventionally used to manufacture heavy base oil, and the reaction conditions thereof are optimized so as to simultaneously manufacture naphthenic base oil and heavy base oil having the qualities desired in the desired yield.

Specifically, the feedstock of naphthenic base oil and the feedstock of heavy base oil are subjected to hydrotreating (HDT) in the presence of a hydrotreating catalyst, so that impurities such as sulfur, nitrogen, metals and PCA are removed therefrom and also that the contained aromatic component may be converted into a naphthenic component via hydrosaturation. The reason why the hydrotreating process is performed is that paraffin, naphthene and aromatic proportions are favorably adjusted so as to be adapted for the quality and composition of base oil products, and also that impurities are removed so as to ensure high quality base oil. In particular, it is mainly intended that impurities which may function as catalyst poisons in downstream dewaxing (or isomerization) and hydrofinishing processes are removed to be below a predetermined level.

The feedstock supplied to a hydrotreating unit includes light cycle oil, slurry oil or a mixture thereof, each of which results from fluid catalytic cracking, and deasphalted oil resulting from solvent deasphalting. These oil fractions may be sequentially or simultaneously subjected to HDT in the presence of an HDT catalyst, in consideration of the desired grade and production yield of the final base oil. Thus, the term "simultaneously manufacturing" used in the present invention should not be limitedly understood only as the meaning in which two or more base oil products are obtained at the same time using a single process, or alternatively, but is rather to be understood to mean that when high quality naphthenic base oil and/or heavy base oil are manufactured using the single catalyst system according to the present invention, high quality naphthenic base oil or heavy base oil may be manufactured alone depending on the desired type of final base oil.

The hydrotreating (HDT) process is performed under conditions including a reaction temperature of 300~410° C., a reaction temperature of 30~220 kg/cm$^2$g, an LHSV of 0.1~3.0 hr$^{-1}$ and a volume ratio of hydrogen to feedstock of 500~3,000 Nm$^3$/m$^3$, whereby the amounts of impurities (e.g. sulfur, nitrogen, metals, etc.) and 2-ring or more aromatic compounds contained in the feedstock may be drastically reduced under optimal conditions of reaction temperature, reaction pressure, and hydrogen supply. As such, the hydrotreating process should be carried out so that the reaction severity thereof is as low as possible within the range that satisfies the impurity level having no influence on the lifetime of the downstream catalysts. The reason is that the degree by which the viscosity of a reaction product is lowered increases proportional to the increase in the reaction severity and thus there is a short fall in the yield of base oil product that is generated by that same degree.

The catalyst used in the hydrotreating process includes one or more selected from among Groups 6, 9 and 10 metals of the periodic table, and particularly includes one or more selected from among Co—Mo, Ni—Mo, and combinations thereof. However, the hydrotreating catalyst used in the present invention is not limited thereto, and any hydrotreating catalyst may be used without limitation as long as it is effective in hydrosaturation and removal of impurities.

The oil fraction obtained after HDT have a remarkably decreased impurity level and appropriate aromatic content, and may have 150 ppm or less sulfur (particularly 100 ppm or less) and 50 ppm or less nitrogen (particularly 10 ppm or less) taking into consideration the effects the oil fraction will have on the downstream catalyst.

Because the oil fraction obtained after HDT is very low in impurities, the downstream catalytic dewaxing reaction may occur more stably and actively, so that the production yield of base oil is high (that is, low yield loss) and selectivity is high, resulting in high quality base oil.

The oil fraction obtained after HDT is dewaxed in the presence of the dewaxing catalyst of the single catalyst system according to the present invention. The dewaxing process according to the present invention indicates that N-paraffin which deteriorates cold properties such as pour point or cloud point is reduced or removed using isomerization or cracking. Hence, after the dewaxing process has been performed, the resulting oil fraction may have good cold properties, thus making it possible to match the pour point specification of base oil.

The catalytic dewaxing process is performed under conditions including a reaction temperature of 250~410° C., a reaction pressure of 30~200 $kg/cm^2g$, an LHSV of 0.1~3.0 $hr^{-1}$ and a volume ratio of hydrogen to feedstock of 150~1000 $Nm^3/m^3$.

The catalyst used in the catalytic dewaxing process includes a support and a metal supported thereto. The support is a support having an acid site selected from among a molecular sieve, alumina, and silica-alumina. Among them, the molecular sieve includes crystalline aluminosilicate (zeolite), SAPO, ALPO or the like, examples of a medium pore molecular sieve having a 10-membered oxygen ring including SAPO-11, SAPO-41, ZSM-5, ZSM-11, ZSM-22, ZSM-23, ZSM-35, and ZSM-48, and examples of a large pore molecular sieve having a 12-membered oxygen ring include FAU, Beta and MOR.

The metal used in the dewaxing catalyst includes metal having hydrogenation activity selected from among Groups 2, 6, 8, 9 and 10 metals of the periodic table. Particularly useful is Co, Ni, Pt or Pd among Groups 9 and 10 (i.e. Group VIII) metals, and also useful is Mo or W among Group 6 (i.e. Group VIB) metals.

In the case where only naphthenic base oil is manufactured in the catalytic dewaxing process, Cut-SLO and LCO used as the feedstock have a very low paraffin content and high aromatic content, and thus the amount of dewaxing reactant is relatively small and impurities (sulfur, nitrogen, etc.) which are difficult to treat in the feedstock are present in a large amount. Thus, the use of a dewaxing catalyst comprising Ni(Co)/Mo(W) which works well regardless of the presence or not of impurities and has high cracking activity is comparatively favorable. Also, high quality naphthenic base oil may be manufactured using an isomerization catalyst (Group 10 metal base) for isomerizing N-paraffin into iso-paraffin. Although an isomerization catalyst using a noble metal typically does not function well in the presence of high impurities, impurities are controlled by means of HDT in the present invention, and thus it is possible to selectively use such catalysts in consideration of the properties and yield of final products.

In the case of deasphalted oil (DAO) used to manufacture heavy base oil, it is obtained from extraction of a solvent deasphalting process (SDA) unit and thus has comparatively high paraffin content. So a Ni(Co)/Mo(W) catalyst having high cracking activity may be used for dewaxing. But, when the above catalyst is used, lube yield may be reduced relatively and more viscosity drop may be occur. Hence, isomerization catalyst using noble metal for isomerizing N-paraffin into iso-paraffin is suitable to meet the target pour point.

In order to simultaneously manufacture high quality naphthenic base oil and heavy base oil from different feedstocks using a single catalyst system according to the present invention, a Ni/Mo catalyst or an isomerization catalyst (Group 10 metal Base) may be applied. The use of an isomerization catalyst (Group 10 metal base) is more favorable in terms of yield and properties for simultaneous production. Specifically, when an isomerization catalyst is used, it is possible to simultaneously manufacture high quality naphthenic base oil and heavy base oil which are equal to or better in terms of performance and yield compared to when using a Ni—Mo dewaxing catalyst.

The dewaxed oil fraction is subjected to hydrofinishing in the presence of a hydrofinishing catalyst of the single catalyst system. The hydrofinishing process removes olefin and polycyclic aromatic components from the dewaxed oil fraction depending on the requirements of product in the presence of a hydrofinishing catalyst, thus ensuring lube product stability (such as oxidation, thermal, UC, etc.), and in particular, finally controls the aromatic content in aspect of manufacturing high quality naphthenic base oil. (especially in case of Naphthenic Base Oil, aromatic contents control is very important according to the product application) This process is typically performed under conditions including a temperature of 150~300° C., a pressure of 30~200 $kg/cm^2$, an LHSV of 0.1~3 $h^{-1}$, and a volume ratio of hydrogen to the supplied oil fraction of 300~1500 $Nm^3/m^3$.

The catalyst used in the hydrofinishing process is provided in the form of a support having a metal supported thereto, in which the metal includes one or more selected from among Groups 6, 8, 9, 10, and 11 elements having hydrogenation activity, and particularly includes sulfide of Ni—Mo, Co—Mo, Ni—W or noble metals such as Pt or Pd.

The support of the catalyst used in the hydrofinishing process may include silica, alumina, silica-alumina, titania, zirconia or zeolite having a large surface area, and particularly includes alumina or silica-alumina. The support functions to increase the dispersibility of metal to thus improve hydrogenation performance and to control the acid site in order to prevent cracking and coking of products.

The liquid product or reactor effluent after hydrotreating (HDT), catalytic dewaxing (CDW) and hydrofinishing (HDF) may be used totally as naphthenic base oil and heavy base oil product, but may be separated using a fractionator according to the application field and the product viscosity grade of naphthenic base oil and heavy base oil. Using such separation, base oil products having various viscosity grade may be finally ensured.

The naphthenic base oil and heavy base oil manufactured according to the present invention may include N460 (kinetic viscosity at 40° C.: 350~420 cSt) as naphthenic base oil, or 150BS (kinetic viscosity at 40° C.: 500~600 cSt) as heavy base oil, each of which was impossible to obtain using conventional methods. For example, SLO may be subjected to vacuum distillation and cutting, and the resulting oil fractions may be appropriately mixed thus obtaining the desired product slate. Alternatively, H-DAO may be combined with part of heavy Cut-SLO (e.g. SLO 55~65% medium Cut), thus increasingly producing heavy viscosity grade naphthenic base oil such as N-460 and heavy base oil such as 150BS.

When the single catalyst system according to the present invention is used, not only may products having low viscosity but also heavy base oil products having high viscosity be obtained, and in addition the product group and yield may be controlled, thus generating economic benefits and exhibiting superior efficiency.

MODE FOR THE INVENTION

A better understanding of the present invention may be obtained through the following examples which are set forth to illustrate, but are not to be construed as limiting the present invention.

Example 1

Manufacture of Base Oil from Effluent of FCC

Among Cut-SLO fractions of Table 1, Cut-1 and Cut-2 were mixed at a volume ratio of 6:4 thus preparing a feedstock, which was then subjected to HDT under conditions including an LHSV of 0.5 $hr^{-1}$, a pressure of 150 $kg/cm^2g$, a reaction temperature of 370° C. and a hydrogen to oil ratio of 1500 NL/L in the presence of a commercially available catalyst having activities of hydrodesulfurization (HDS), hydrodenitrogenation (HDN) and hydrodemetallization (HDM), so that sulfur and nitrogen were reduced to 100 ppm or less and 10 ppm or less, respectively.

Subsequently, the oil fraction obtained after HDT was subjected to Catalytic dewaxing (CDW) unit using an isomerization catalyst comprising Pt/zeolite and to HDF using an HDF catalyst composed of $(Pt/Pd)/Al_2O_3$. The CDW and HDF were performed under conditions including a reaction pressure of 140~150 $kg/cm^2g$, an LHSV of 1.0~2.0 $hr^{-1}$, and a hydrogen to oil ratio of 400~600 $Nm^3/m^3$. As such, the reaction temperature of CDW was 330~360° C., and the reaction temperature of HDF was 200~250° C. This reaction temperature was set so that the pour point of the effluent of CDW was −40~45° C.

The resulting properties of the feedstock of the present example and the reaction product after HDT/CDW/HDF (before separation using a fractionator) are shown in Table 3 below.

TABLE 3

| | | Cut-SLO | Oil Fraction after Reaction |
|---|---|---|---|
| Pour Pt. | ° C. | 10 | −45 |
| Kvis | 40° C. | — | 21.40 |
| | 100° C. | | 3.75 |
| Sulfur | wt. ppm | 10,600 | 23.5 |
| Nitrogen | wt. ppm | 2,030 | 2.8 |
| HPLC | MAH % | 9.0 | 32.1 |
| (Aromatic | DAH % | 13.7 | 2.5 |
| Analysis) | PAH % | 64.4 | 0.4 |
| | TAH % | 87.1 | 35.0 |
| Distillation | IBP | 262 | 177 |
| (%) D-2887 | 10% | 340 | 264 |
| | 30% | 369 | 303 |
| | 50% | 395 | 331 |
| | 70% | 418 | 367 |
| | 90% | 453 | 435 |
| | FBP | 501 | 495 |

As is apparent from Table 3, the oil fraction obtained after HDF may be used totally as a naphthenic base oil product, or final naphthenic base oil may be separated therefrom in a downstream fractionator in order to obtain various products according to the viscosity grade. The properties of the separated final naphthenic base oil are shown in Table 4 below.

TABLE 4

| | | N46 | N49 | N110 | N460 |
|---|---|---|---|---|---|
| SPGR | 15/4° C. | 0.9034 | 0.9455 | 0.9472 | 0.9298 |
| Pour Pt. | ° C. | −50 or less | −30 | −25 | −12 |
| Kvis | 40° C. | 9.05 | 46.7 | 105 | 386 |
| | 100° C. | 2.25 | 4.93 | 7.68 | 16.83 |
| Sulfur | wt. ppm | 0.11 | 14.1 | 25.5 | 128 |
| Nitrogen | wt. ppm | 0.27 | 4.34 | 4.53 | 22.1 |
| Hydrocarbon | Cn % | 70 | 63.7 | 56.2 | 39.9 |
| HPLC | MAH % | 22.9 | 46.5 | 42.8 | 26.3 |
| (Aromatic | DAH % | 0.8 | 3.6 | 5.2 | 5.1 |
| Analysis) | PAH % | 0.1 | 0.4 | 0.9 | 2.4 |
| | TAH % | 23.8 | 50.5 | 49.0 | 33.8 |
| Distillation | 10% | 281 | 332 | 342 | 399 |
| (%) D-2887 | 30% | 296 | 342 | 367 | 439 |
| | 50% | 307 | 353 | 389 | 464 |
| | 70% | 316 | 368 | 410 | 491 |
| | 90% | 327 | 394 | 438 | 526 |

Example 2

Manufacture of Base Oil from Effluent (H-DAO Subjected to Vacuum Distillation) of SDA Heavy base oil (500N/150BS or the like) was manufactured at high yield under the same (single) catalyst/process conditions as when manufacturing the naphthenic base oil from Cut-SLO. Specifically, heavy deasphalted oil (H-DAO) shown in Table 2 was subjected to HDT under conditions including an LHSV of 0.5~1.0 $hr^{-1}$, a pressure of 150 $kg/cm^2g$, a reaction temperature of 350~360° C. and a hydrogen to oil ratio of 1,000~1500 NL/L in the presence of a commercially available catalyst having activities of HDS, HDN and HDM, so that sulfur and nitrogen were reduced to 50 ppm or less and 5 ppm or less, respectively.

Subsequently, the oil fraction obtained after HDT was subjected to CDW using an isomerization catalyst comprising Pt/zeolite and to HDF in the presence of an HDF catalyst composed of $(Pt/Pd)/Al_2O_3$. The reaction was performed under conditions including a reaction pressure of 140~150 $kg/cm^2g$, an LHSV of 1.0~2.0 $hr^{-1}$, and a hydrogen to oil ratio of 400~600 $Nm^3/m^3$. As such, the reaction temperature of CDW was 330~360° C., and the reaction temperature of HDF was 200~250° C. This reaction temperature was set so that the pour point of the effluent of CDW was −20° C. or lower.

The resulting properties of the feedstock of the present example and the reaction product after HDT/CDW/HDF (before separation using a fractionator) are shown in Table 5 below.

TABLE 5

| | | H-DAO | Oil Fraction after Reaction |
|---|---|---|---|
| Pour Pt. | ° C. | 57 | −23 |
| Kvis | 40° C. | — | 75.6 |
| | 100° C. | 29.2 | 11.3 |
| Sulfur | wt. ppm | 29,000 | 0.78 |
| Nitrogen | wt. ppm | 1,420 | 0.5 |
| HPLC | MAH % | 35.5 | 0.8 |
| (Aromatic | DAH % | 11.0 | 0.01 |
| Analysis) | PAH % | 8.9 | 0.01 |
| | TAH % | 55.4 | 0.802 |
| Distillation | IBP | 410 | 188 |
| (%) D-2887 | 10% | 481 | 334 |
| | 30% | 523 | 470 |

TABLE 5-continued

| | H-DAO | Oil Fraction after Reaction |
|---|---|---|
| 50% | 555 | 523 |
| 70% | 586 | 563 |
| 90% | 636 | 612 |
| FBP | 720 | 685 |

As is apparent from Table 5, the oil fraction having high viscosity on the order of K-Vis@40° C. of 75~80 is ensured, and the total oil fraction may be used as a product, or final heavy base oil may be separated therefrom in a downstream fractionator in order to obtain products having high viscosity such as 500N and 150BS. The main properties of the separated final base oil are shown in Table 6 below. In the case of base oil obtained by passing H-DAO through the single catalyst system, the yield of heavy base oil of 500N or more is measured to be 78~80%.

TABLE 6

| | | 500N | 150BS |
|---|---|---|---|
| Kvis | 40° C. | 95~98 | 568.5 |
| | 100° C. | 10.65 | 32.1 |
| Pour Pt. | ° C. | −18 | −10 |
| HPLC | MAH % | 0.9 | 0.8 |
| (Aromatic | DAH % | 0.3 | 0.3 |
| Analysis) | PAH % | 0.1 | 0.2 |
| | TAH % | 1.3 | 1.3 |

Example 3

Manufacture of Base Oil from Effluent (DAO not Subjected to Vacuum Distillation) of SDA Base oil was manufactured from DAO (not subjected to vacuum distillation) under the same (single) catalyst/process conditions as when manufacturing the naphthenic base oil and heavy base oil from Cut-SLO and H-DAO. Specifically, Full Range DAO shown in Table 2 was subjected to HDT under conditions including an LHSV of 0.5~1.0 $hr^{-1}$, a pressure of 150 $kg/cm^2g$, a reaction temperature of 350~360° C. and a hydrogen to oil ratio of 1,000~1500 NL/L in the presence of a commercially available catalyst having activities of HDS, HDN and HDM, so that sulfur and nitrogen were reduced to 50 ppm or less and 5 ppm or less, respectively.

Subsequently, the oil fraction obtained after HDT was subjected to CDW using an isomerization catalyst comprising Pt/zeolite and to HDF in the presence of an HDF catalyst composed of $(Pt/Pd)/Al_2O_3$. The reaction was performed under conditions including a reaction pressure of 140~150 $kg/cm^2g$, an LHSV of 1.0~2.0 $hr^{-1}$, and a hydrogen to oil ratio of 400~600 $Nm^3/m^3$. As such, the reaction temperature of CDW was 310~340° C., and the reaction temperature of HDF was 200~250° C. This reaction temperature was set so that the pour point of the effluent of CDW was −40° C. or lower.

The resulting properties of the feedstock of the present example and the reaction product after HDT/CDW/HDF (before separation using a fractionator) are shown in Table 7 below.

TABLE 7

| | | Full Range DAO | Oil Fraction after Reaction |
|---|---|---|---|
| Pour Pt. | ° C. | +48 | −40 |
| Kvis | 40° C. | 237.6 | 32.54 |
| | 100° C. | 13.5 | 4.131 |
| Sulfur | wt. ppm | 2.8 | 5.9 |
| Nitrogen | wt. ppm | 930 | 0.5 |
| HPLC | MAH % | 32.0 | 2.5 |
| (Aromatic | DAH % | 10.5 | — |
| Analysis) | PAH % | 7.7 | 0 |
| | TAH % | 50.2 | 2.5 |
| Distillation | IBP | 247 | 55.6 |
| (%) D-2887 | 10% | 380 | 256.4 |
| | 30% | 446 | 365.2 |
| | 50% | 493 | 428.6 |
| | 70% | 539 | 486.2 |
| | 90% | 606 | 536.0 |
| | FBP | 720 | 607.0 |

As is apparent from Table 7, products having low viscosity or medium viscosity on the order of K-Vis@40° C. of about 32.5 and K-Vis@100° C. of about 4.1 can be seen to be contained in a considerable amount. (In the case where only H-DAO of Example 2 is treated, heavy base oil such as 500N or more having K-Vis@40° C. of about 80 is mainly contained). The total oil fractions were separated on the basis of the viscosity range. The results are shown in Table 8 below.

TABLE 8

| | | 60/70N | 100N | 150N | 500N | 150BS |
|---|---|---|---|---|---|---|
| Kvis | 40° C. | 13.3 | 22.5 | 31.6 | 95~98 | 568.5 |
| | 100° C. | 3.0 | 4.1 | 5.1 | 10.7 | 32.1 |
| Pour Pt. | ° C. | −28 | −15 | −15 | −18 | −10 |

As is apparent from Table 8, light or medium base oil products, such as 60/70N, 100N, 150N, are produced in an amount of about 40~45%, and heavy base oil such as 500N or more is produced in a comparatively low amount of 30% or less. In Examples 2 and 3, heavy base oil products such as 500N or more can be seen to be manufactured. Also, DAO obtained using deasphalting may be used unchanged, or may be subjected to vacuum distillation thus controlling the type and yield of final products.

Example 4

Manufacture of Base Oil from Mixture Comprising Effluent of FCC and Effluent of SDA Heavy base oil (e.g. 500N/150BS) was manufactured in high yield from a mixture of H-DAO which is the main feedstock of heavy base oil and a heavy fraction (SLO 50~65% Cut) of the main feedstock of naphthenic base oil, under the same (single) catalyst/process conditions as in the above examples. In the case where the feedstock of the naphthenic base oil is mixed as in the present example, the aromatic content of heavy base oil such as 150BS is increased thus making it possible to manufacture products having improved cold properties. The H-DAO of Table 2 was mixed with a feedstock (SLO 50~65% Cut) of naphthenic base oil of Table 9 below at a mass ratio of 7:3, thus preparing a feedstock. The properties of the feedstock are shown in Table 9 below.

TABLE 9

| | Unit | H-DAO | SLO Cut (50~65%) | Mixture (7:3) |
|---|---|---|---|---|
| API | 60° F. | 20.3 | 3.4 | 15.2 |
| Sulfur | Wt % | 2.9 | 1.3 | 2.4 |
| Nitrogen | wt ppm | 1,420 | 1,735 | 1,515 |
| HPLC | MAH (%) | 35.5 | 10.1 | 27.9 |
| Aromatic | DAH (%) | 11.0 | 8.5 | 10.2 |
| Analysis | PAH (%) | 8.9 | 61.9 | 24.8 |
| | TAH (%) | 55.4 | 80.6 | 62.9 |
| Distillation | IBP | 410 | 364.2 | 376.0 |
| (%) ASTM | 10% | 481 | 391.4 | 422.9 |
| D-2887 | 30% | 523 | 422.0 | 479.6 |
| | 50% | 555 | 443.2 | 525.2 |
| | 70% | 586 | 463.0 | 568.2 |
| | 90% | 636 | 491.9 | 624.4 |
| | FBP | 720 | 523.6 | 696.6 |

The above feedstock was subjected to HDT under conditions including an LHSV of 0.5~1.0 $hr^{-1}$, a reaction pressure of 150 $kg/cm^2g$, a reaction temperature of 360~380° C., and a hydrogen to oil ratio of 1,500~2,000 NL/L in the presence of a commercially available catalyst having activities of HDS, HDN and HDM, so that sulfur and nitrogen were reduced to 100 ppm or less and 10 ppm or less, respectively.

Subsequently, the oil fraction obtained after HDT was subjected to CDW in the presence of an isomerization catalyst comprising Pt/zeolite and to HDF in the presence of an HDF catalyst composed of $(Pt/Pd)/Al_2O_3$. The reaction was performed under conditions including a reaction pressure of 140~150 $kg/cm^2g$, an LHSV of 1.0~2.0 $hr^{-1}$, and a hydrogen to oil ratio of 400~600 $Nm^3/m^3$. As such, the reaction temperature of CDW was 330~360° C., and the reaction temperature of HDF was 200~250° C. This reaction temperature was set so that the pour point of the effluent of CDW was −20° C. or lower.

The resulting properties of the feedstock of the present example and the reaction product after HDT/CDW/HDF (before separation using a fractionator) are shown in Table 10 below.

TABLE 10

| | | Mixture | Oil Fraction after Reaction |
|---|---|---|---|
| Pour Pt. | ° C. | 51 | −20 |
| Kvis | 40° C. | — | 137.2 |
| | 100° C. | 36.8 | 13.6 |
| Sulfur | wt. ppm | 2.4 | 49.2 |
| Nitrogen | wt. ppm | 1,515 | 4.6 |
| HPLC | MAH % | 27.9 | 8.5 |
| (Aromatic | DAH % | 10.2 | 1.8 |
| Analysis) | PAH % | 24.8 | 0.7 |
| | TAH % | 62.9 | 11.0 |
| Distillation | IBP | 376.0 | 296.0 |
| (%) D-2887 | 10% | 422.9 | 357.9 |
| | 30% | 479.6 | 414.6 |
| | 50% | 525.2 | 475.2 |
| | 70% | 568.2 | 533.2 |
| | 90% | 624.4 | 614.4 |
| | FBP | 696.6 | 693.6 |

As is apparent from Table 10, the oil fraction having high viscosity on the order of K-Vis@40° C. of about 137 and K-Vis@100° C. of 13.6 is ensured, and the total oil fraction may be used unchanged as a product, or final heavy base oil may be separated therefrom in a downstream fractionator in order to obtain products having high viscosity such as 500N and 150BS. In conclusion, heavy base oil such as 500N or more may be ensured at a high yield of 85% or more (particularly in the case of 150BS, a yield of 30% or more). The main properties of the separated final base oil are shown in Table 11 below.

TABLE 11

| | | 150N | 500N (Main Product) | 150BS (Main Product) |
|---|---|---|---|---|
| Kvis | 40° C. | 48.1 | 97~101 | 546 |
| | 100° C. | 6.62 | 10.8 | 33.5 |
| Pour Pt. | ° C. | −25 | −20 | −11 |
| HPLC | MAH % | 5.8 | 9.7 | 5.4 |
| (Aromatic | DAH % | 0.7 | 1.3 | 2.5 |
| Analysis) | PAH % | 0.1 | 0.5 | 0.9 |
| | TAH % | 6.6 | 11.5 | 9.8 |

Example 5

Manufacture of Base Oil Using Isomerization Catalyst (Group 10 Metal Base) or Ni/Mo Catalyst as Dewaxing Catalyst Heavy base oil products were manufactured using an isomerization catalyst (Group 10 noble metal base) and a Ni/Mo catalyst, and the properties thereof were compared. Specifically, H-DAO of Table 2 was subjected to HDT under conditions including an LHSV of 0.5~1.0 $hr^{-1}$, a reaction pressure of 150 $kg/cm^2g$, a reaction temperature of 350~360° C. and a hydrogen to oil ratio of 1,000~1500 NL/L in the presence of a commercially available catalyst having activities of HDS, HDN and HDM, so that sulfur and nitrogen were reduced to 50 ppm or less and 5 ppm or less, respectively.

Subsequently, the oil fraction obtained after HDT was subjected to CDW using two catalysts, one of which was an isomerization catalyst comprising a zeolite support and Group 10 metal Pt supported thereto and the other of which was a catalyst comprising the same zeolite support and Ni/Mo metal supported thereto, and to HDF in the presence of an HDF catalyst composed of $(Pt/Pd)/Al_2O_3$. The CDW was performed under conditions including a reaction pressure of 140~150 $kg/cm^2g$, an LHSV of 1.0~2.0 $hr^{-1}$, and a hydrogen to oil ratio of 400~600 $Nm^3/m^3$. As such, the reaction temperature of CDW was 310~380° C., and the reaction temperature of HDF was 200~250° C. This reaction temperature of CDW was set so that the pour point of the effluent of CDW was −20~25° C.

After completion of the reaction, the reaction temperature and the base oil yield when using the two types of dewaxing catalyst are shown in Table 12 below.

TABLE 12

| | Isomerization Dewaxing Catalyst (having supported Group 10 Metal) | Ni/Mo Supported Dewaxing Catalyst |
|---|---|---|
| Pour Pt. of Effluent of CDW | −20~−25° C. | −20~−25° C. |
| CDW Reaction Temp., ° C. | 315~320 | 350~360 |
| Product Yield, wt % (HDT + CDW + HDF) | | |
| Off-Gas/Naphtha | 5.4 wt % | 15.3 wt % |
| Fuel (Kero/Diesel) & Light Lube | 16.5 wt % | 16.1 wt % |

TABLE 12-continued

| | Isomerization Dewaxing Catalyst (having supported Group 10 Metal) | Ni/Mo Supported Dewaxing Catalyst |
|---|---|---|
| Heavy Base Oil (500N or more) | 78.1 wt % | 68.6 wt % |

As is apparent from Table 12, when comparing heavy base oil products in terms of yield and reaction temperature under the same reaction conditions of the single catalyst system except for the dewaxing catalyst, the isomerization dewaxing catalyst having a Group 10 noble metal supported thereto is more favorable than when using the Ni/Mo supported catalyst upon manufacturing heavy base oil from DAO.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of simultaneously manufacturing high quality naphthenic base oil and heavy base oil using a single catalyst system comprising a hydrotreating catalyst, a dewaxing catalyst and a hydrofinishing catalyst, the method comprising:

(a) preparing the feedstock for naphthenic base oil by separating appropriately light cycle oil or slurry oil which is produced by subjecting atmospheric residue to fluid catalytic cracking;

(b) preparing the feedstock for heavy base oil by separating appropriately the deasphalted oil which is produced by subjecting vacuum residue or a mixture comprising atmospheric residue and vacuum residue to solvent deasphalting;

(c) sequentially or simultaneously hydrotreating the light cycle oil, the slurry oil or a mixture thereof separated in (a) and the deasphalted oil separated in (b) using the hydrotreating catalyst, thus obtaining a hydrotreated oil fraction;

(d) catalytic dewaxing the hydrotreated oil fraction using the dewaxing catalyst, thus obtaining a dewaxed oil fraction; and (e) hydrofinishing the dewaxed oil fraction using the hydrofinishing catalyst, thus obtaining a hydrofinished oil fraction, wherein the slurry oil used in (c) is cut-slurry oil obtained by subjecting the slurry oil from FCC (fluid catalytic cracking) to vacuum distillation, or deasphalted slurry oil obtained by subjecting the slurry oil separated by fluid catalytic cracking to solvent deasphalting.

2. The method according to claim 1, wherein the deasphalted oil used in (c) is heavy deasphalted oil obtained by subjecting the deasphalted oil from SDA (solvent deasphalting Process) to vacuum distillation.

3. The method according to claim 1, further comprising (f) fractionating the hydrofinished oil fraction according to a viscosity grade.

4. The method according to claim 1, wherein the hydrotreating in (c) is performed under conditions including a reaction temperature of 300~410° C., a reaction pressure of 30~220 $kg/cm^2g$, and a liquid hourly space velocity of 0.1~3.0 $hr^{-1}$, and the hydrotreating catalyst comprises one or more components selected from among Groups 6 and 8 to 10 elements of the periodic table.

5. The method according to claim 1, wherein the dewaxing in (d) is performed under conditions including a reaction temperature of 250~410° C., a reaction pressure of 30~200 $kg/cm^2g$, and a liquid hourly space velocity of 0.1~3.0 $hr^{-1}$, and the dewaxing catalyst comprises one or more supports selected from among a molecular sieve, alumina, and silica-alumina, and one or more metals selected from among Groups 2, 6, 9 and 10 elements of the periodic table.

6. The method according to claim 5, wherein the dewaxing catalyst comprises one or more supports selected from among SAPO-11, SAPO-41, ZSM-5, ZSM-11, ZSM-22, ZSM-23, ZSM-35, ZSM-48, FAU, BETA and MOR and one or more metals selected from among platinum, palladium and nickel.

7. The method according to claim 1, wherein the hydrofinishing in (e) is performed under conditions including a reaction temperature of 150~300° C., a reaction pressure of 30~200 $kg/cm^2g$, and a liquid hourly space velocity of 0.1~3.0 $hr^{-1}$, and the hydrofinishing catalyst comprises one or more supports selected from among silica, alumina, silica-alumina, titania, zirconia, and zeolite, and one or more metals selected from among Groups 6, 8, 9, 10 and 11 elements of the periodic table.

8. The method according to claim 3, simultaneously manufacture high quality naphthenic base oil and heavy base oil, wherein the naphthenic base oil separated in (f) comprises naphthenic base oil having a kinetic viscosity at 40° C. of 350~550 cSt, and the heavy base oil separated in (f) comprises heavy base oil having a kinetic viscosity at 40° C. of 500~600 cSt.

* * * * *